US005162778A

United States Patent [19]

Williamson

[11] Patent Number: 5,162,778

[45] Date of Patent: Nov. 10, 1992

[54] PORTABLE PERSONAL PROPERTY PROTECTOR

[76] Inventor: Mark Williamson, 258 Sound Beach Ave., Old Greenwich, Conn. 06870

[21] Appl. No.: 684,971

[22] Filed: Apr. 15, 1991

[51] Int. Cl.[5] ..... G08B 13/14

[52] U.S. Cl. ..... 340/571; 340/429; 340/689

[58] Field of Search ..... 340/571, 689, 429

[56] References Cited

U.S. PATENT DOCUMENTS 2,618,712 11/1952 Moledzky ..... 340/429
4,155,067 5/1979 Gleeson ..... 340/429
4,167,733 9/1979 Krause et al. ..... 340/571
4,497,118 2/1985 Byrum ..... 340/689

*Primary Examiner*—Glen R. Swann, III
*Attorney, Agent, or Firm*—Alfred E. Miller

[57] ABSTRACT

A portable anti-theft device has a gravity operated switch, settable manually or by action of gravity to an open position. This switch is connected in series with a key switch and an alarm, to provide an alarm when the gravity operated switch is moved. The gravity operated switch may be a mercury switch. The gravity operated switch may be pendularly mounted, and be restrained from movement by operation of the key switch.

5 Claims, 3 Drawing Sheets

PORTABLE PERSONAL PROPERTY PROTECTOR

FIELD OF THE INVENTION

This invention relates to a device adapted to be positioned in or on an object, for providing a warning in the event of unauthorized movement of the object.

BACKGROUND OF THE INVENTION

It is known to provide an arrangement for generating an alarm signal when an object is moved. For example, in one type of alarm device, a mercury or other conductive liquid body switch is positioned to be moved upon movement of the object, thereby to initiate the energization of an alarm such as a buzzer. (U.S. Pat. Nos. 4,833,456 and 3,740,648). Such devices may be anti-theft alarm devices.

In an alarm device of this type, it is recognized that return of the object to its original position may restore the switch to its original non-contacting state, so that the switch itself cannot be relied upon for continuing the generation of the alarm signal. For this purpose, devices having two stable states, such as flip-flops, SCR's, or the like, have been employed to maintain the energization of the alarm, once it has been initiated by the motion or movement sensing switch (U.S. Pat. Nos. 4,274,088 and 4,151,520).

It is also known to provide key switches or the like, in an object protection alarm device, to prevent the continued generation of the alarm signal, or to prevent the initiation of the alarm signal. (U.S. Pat. Nos. 4,274,088 and 4,023,157).

In general, alarm devices employing conductive liquid motion sensors require the device to be initially positioned in a specific orientation at which an alarm signal is not generated. This feature has now been found to limit the application of portable alarm devices of this type.

While it is known to provide arrangements for changing the orientation of a liquid level sensor in a device, such arrangements have in general been employed only to enable the proper orientation of an instrument at a given angular position.

SUMMARY OF THE INVENTION

The present invention is therefore directed to the provision of an anti-theft device adapted to be affixed to or positioned in an object, wherein the device may be adjusted so to have any desired angular orientation, with respect to the horizontal.

Briefly stated, in accordance with the invention, a level-sensitive (i.e. gravity sensitive) switch, such as a mercury switch, is mounted in a manner that it can be pivoted about a given axis. The mounting may be such as to enable the switch to rotate freely under the forces of gravity, in which case an additional braking arrangement is provided to selectively hold the switch at a given angular relationship with respect to the object to be protected. Alternatively, the switch may be manually pivotable, so as to retain its position when it is not being manually moved.

The portable anti-theft device is adapted to be mounted in or with respect to an article or objected to be protected, so that, when the article is moved to a determined extent, the level-sensitive switch closes to energize an alarm.

The circuit for the portable anti-theft device advantageously includes a key operated switch connected in series with the level-sensitive switch, the key operated switch also incorporating the braking arrangement for selectively holding the level-sensitive switch.

BRIEF DESCRIPTION OF THE DRAWING

In order that the invention may be more clearly understood, it will now be disclosed in greater detail with reference to the accompanying drawing, wherein.

DETAILED DISCLOSURE OF THE INVENTION

Figure 1:
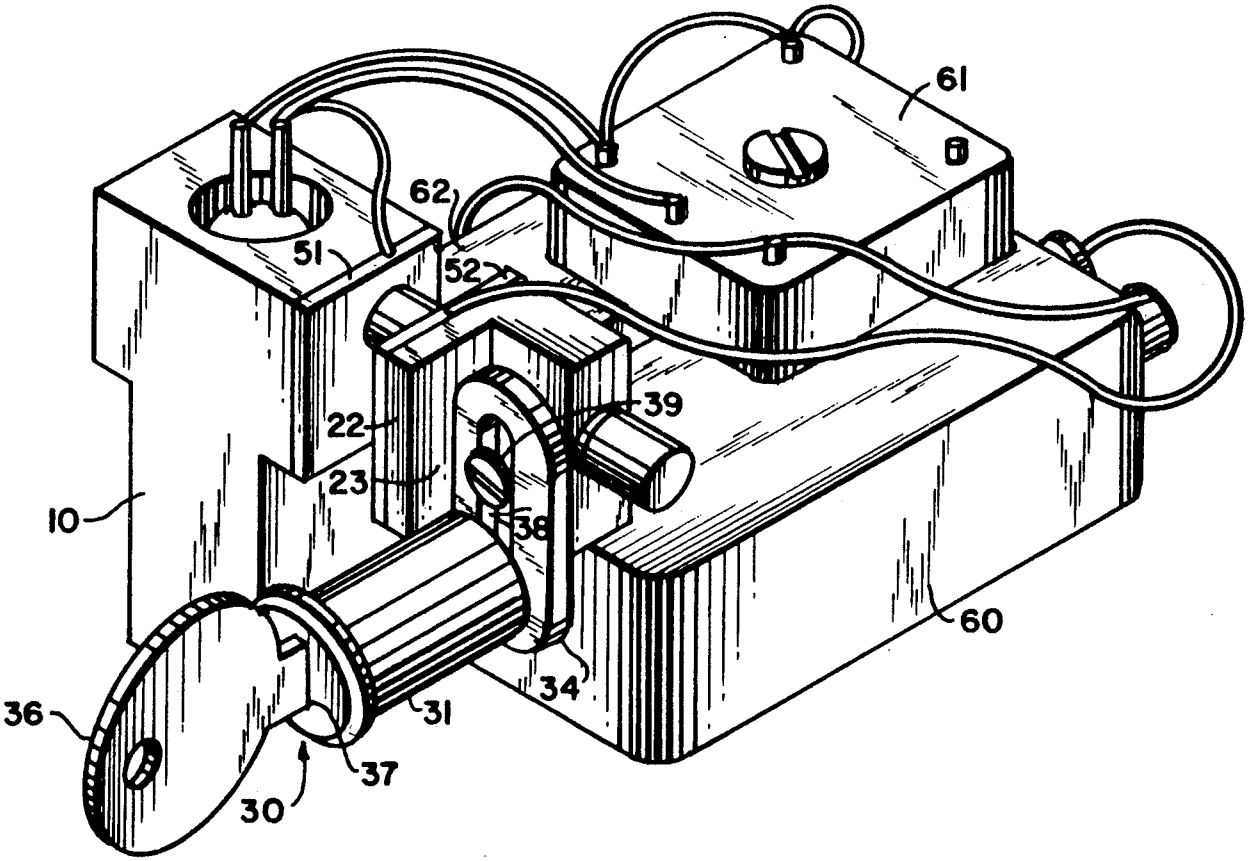
FIG. 1 is a perspective view of the internal components of a portable anti-theft device in accordance with one embodiment of the invention, without a casing thereon.
Figure 2:
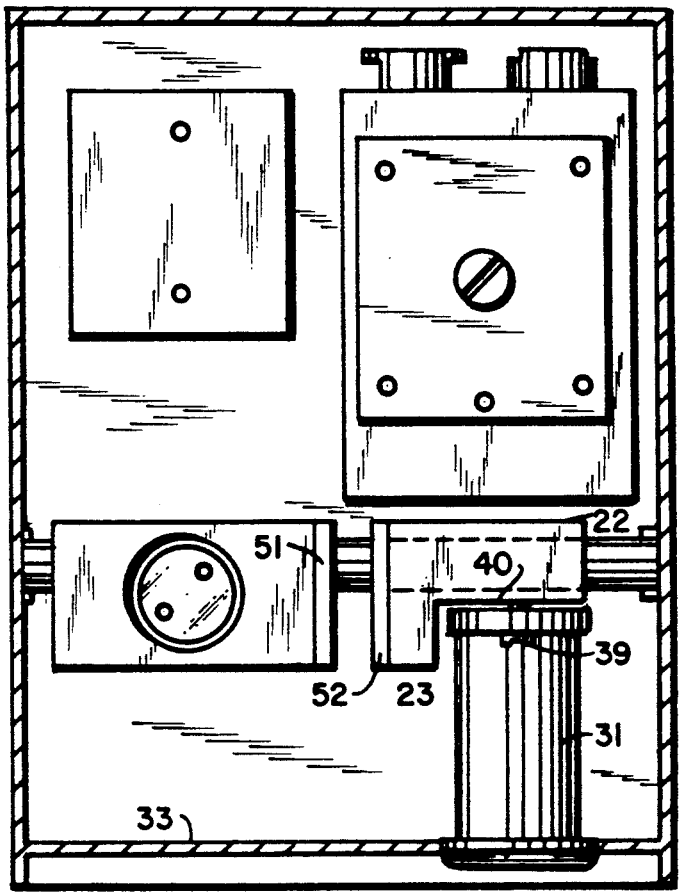
FIG. 2 is a top view of the portable anti-theft device of FIG. 1, without the top of the casing.
Figure 3:
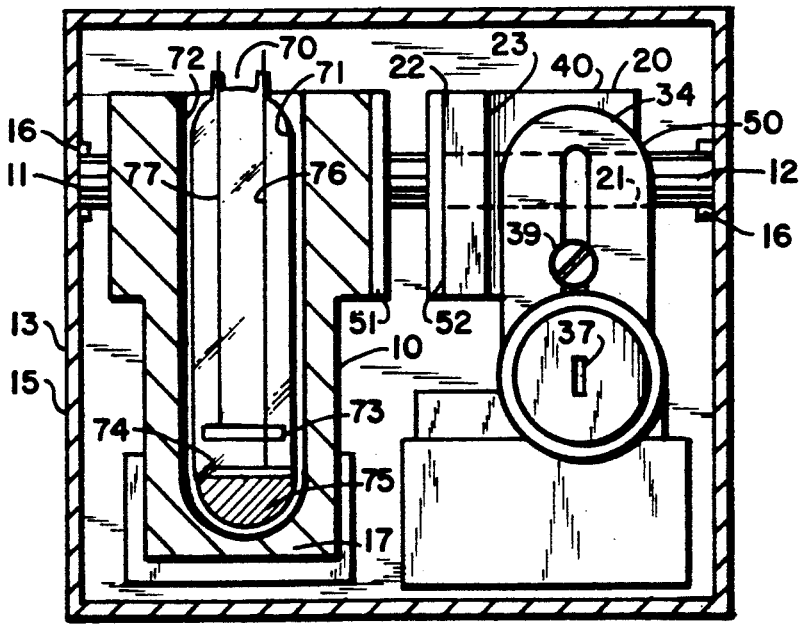
FIG. 3 is a partially cross sectional view of the portable anti-theft device of FIG. 1, without the front of the casing.

Referring now to FIGS. 1-3, a portable anti-theft device includes a pendulum block 10 having aligned shafts 11, 12 extending horizontally from opposite sides thereof. The shafts 11, 12 are freely pivotally mounted to the sidewalls 13, 14 of a casing 15. For example, suitable pivot sockets 16 may be formed on the inside walls of the casing in order to enable the pendulum block 10 to be freely pivotable. The greater part of the mass of the pendulum block is located below the axes of the shafts 11, 12, so that the forces of gravity tend to swing the block to a position with its bottom end 17 downwardly.

A contact block 20 has a guide hole 21 that slidable receives the shaft 12, between the pendulum block 10 and the side wall 14 of the casing. The contact block 20 has a cam flange 22 extending forwardly, with a vertical cam-riding surface 23 parallel to the side wall 14 of the casing 15, and toward the side wall 14.

A lock assembly, for example a cylinder lock 30 has its cylinder 31 mounted in conventional manner to the front wall 33 of the casing 15. A cam 34 is mounted at the rear of the lock assembly to the tumbler (not shown) thereof, to be rotatable about the axis of the cylinder when the key 36 is inserted in the slot 37 of the lock and rotated. The cam 34 extends upwardly of the cylinder 31, and has a vertically extending guide slot 38 extending therethrough. A screw or pin 39 extends through the slot 38 and into a vertical surface 40 of the contact block 20. The head of the screw or pin 40 does not tightly engage the cam 34, so that, as the key in the lock is turned, the sides of the guide slot apply forces to the pin 40 to move the contact block 20 along the shaft 12. The distal end of the cam 34 is rounded to form a cam surface 50 adapted to engage the cam surface 23.

A first contact 51 is provided on the face of the pendulum block 10 toward the wall 14, this face being parallel to the wall 14. A second contact 52 is provided on the face of the contact block toward the pendulum block, this face of the contact block being parallel to the face of the block 10 on which the contact 51 is mounted. When the key 36 of the lock is in the position illustrated in FIG. 1, the guide slot 38 is positioned to hold the contacts 51 and 52 apart. Upon rotation of the key in the counterclockwise direction, however, the cam surface 50 of the cam 34 engages the cam-riding surface 23, to force the contact toward and into contacting engagement with the contact 51. This contacting engagement not only provides electrical contact between the contacts 51 and 52, but also serves to mechanically lock the contact block to the pendulum block, to prevent free rotation of the pendulum block under the forces of gravity.

A battery 60, a relay 61 and an alarm device 62, are also mounted by conventional means in the casing 15. In one embodiment of the invention, the battery is a 9 volt battery, and the relay 61 is a 9 volt relay, such a relay No. 275-005 sold by Radio Shack. The alarm 62 may be a 9 volt alarm device for producing an audible alarm when energized.

A gravity-sensitive switch, for example, a mercury switch 70, is mounted in the pendulum block 10. In the disclosed embodiment of the invention, the mercury switch 70 is comprises of a sealed bulb 71 mounted in a vertically extending recess 72 of the pendulum block 10. Upper and lower vertically spaced apart contacts 73, 74 are affixed to the inside of the lower end of the bulb 71. For example, the lower contact 74 may coat the inside of the lower end of the bulb, up to a given height, and the contact 73 may be an annular contact coating spaced by a small gap from the top of the contact 74. The lower portion of the bulb contains a pool 75 of mercury, of a depth such that it does not bridge the gap between the contacts 73 and 74. Leads 76 and 77 contact the contacts 73 and 74 respectively, and extend sealingly through the top of the bulb.

Figure 4:
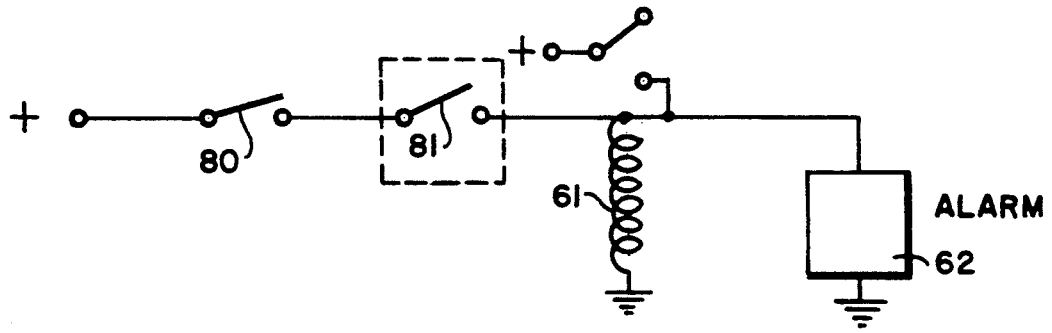
FIG. 4 is a circuit diagram of a portable anti-theft device in accordance with the invention.

A circuit that may be employed for the portable anti-theft device of FIGS. 1-3 is illustrated in FIG. 4. In this circuit, one terminal of a switch 80 is connected to the positive terminal of a voltage source, and the other terminal of the switch 80 is connected to one terminal of a switch 81. The switch 80 corresponds to the switch defined by the contacts 51, 52, and the switch 81 corresponds to the mercury switch of FIGS. 1-3. The coil of the relay 61 is connected between the other terminal of the switch 81 and the negative terminal of the voltage source. The alarm device 62 is connected between the other terminal of the switch 81 and the negative terminal of the voltage source. The center arm of the contacts of the relay 62 is connected to the other contact of the voltage source, and the normally open contact of the relay is connected to the coil thereof, to serve as a holding contact.

In operation, the portable anti-theft device is initially placed in association with an article, to be protected, for example a suitcase, with the key in the lock holding the contacts 51, 52 apart (i.e. with the switch 80 open). This permits the pendulum block to pivot freely, to assume a position with the bottom 71 thereof in its lowermost position, and the mercury pool hence separated from the contact 73 (i.e. with the switch 81 also open). The key 36 is then rotated until the cam 34 forces the contact 51 against the contact 52, thereby closing switch 80 of FIG. 4. At this time the key is removed from the lock, and the portable anti-theft device is armed to protect the article.

If the article to be protected is moved in a manner to cause the pool of mercury to bridge the contacts 73, 74, closing the switch 81, the relay 61 will be energized, and the alarm 62 will also be energized since the switch 81 also applies a voltage to the alarm. Returning the article to its initial position will not effect the deenergization of the alarm, since the contacts of the relay are now closed, maintaining the relay in an energized condition. The alarm may only be deenergized by reinserting the key in the lock, to break the connection between the positive voltage terminal and the mercury switch and holding contacts of the relay.

Figure 5:
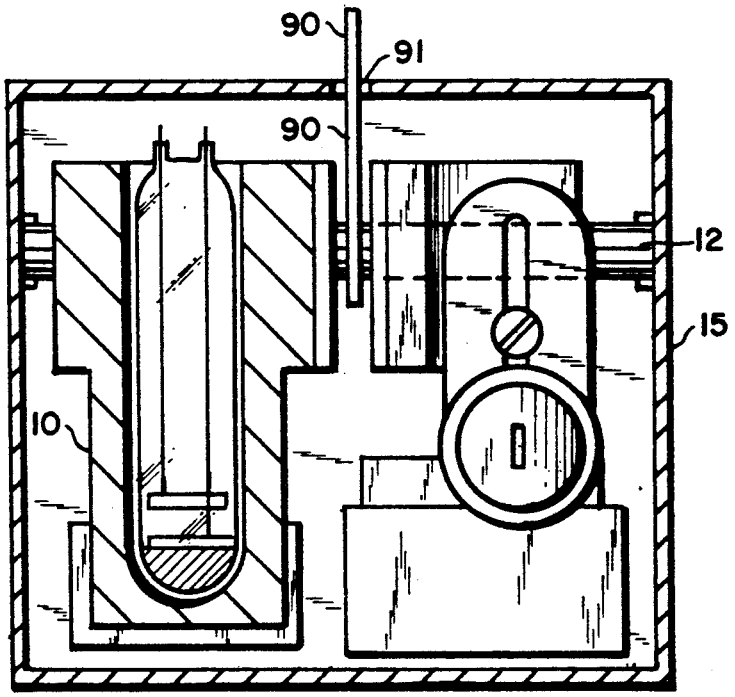
FIG. 5 is a front view of a modification of the portable anti-theft device, without the front of the casing and partially in cross section.

In a modification of the invention, as illustrated in FIG. 5, the block 10 may be mounted so that it is pivotable in the casing, but not freely pivotable under the force of gravity. In this modification, a lever 90 may be affixed to the shaft 12, to extend through an elongated slot in the casing 15. Rather than depending upon gravity to align the mercury switch to its non-contacting position, as in the arrangement of FIGS. 1-3, the operator can now pivot the block 10 by manipulating the lever, for example until it extending in a purely vertical direction. Otherwise, however, the arrangement of FIG. 5 operates in the same manner as the arrangement of FIGS. 1-3.

While the invention has bee disclosed and described with reference to a limited number of embodiments, it will be apparent that variations and modification may be made therein. For example, it is not necessary to employ the specifically disclosed apparatus for permitting free rotation of the mercury switch, and the mercury switch may be replaced by an other conventional gravity-operated switch. Similarly, the conductive liquid in the bulb 71 is not necessarily mercury. While a specific cam operated mechanism is illustrated for closing the switch 80 and mechanically restraining the gravity switch, other similarly functioning devices may be alternatively employed. Still further, although the contacts 51, 52 are illustrated as being applied directly to the blocks 10 and 20, thereby requiring the use of insulating material for the blocks, these blocks may be conductive and separated from the contacts by suitable insulation sheets.

In addition, it is apparent that conventional semiconductor circuit, for example a flip-flop IC latch circuit, may be employed as an alternative to the relay 62.

It is therefore intended in the following claims to cover each such variation and modification as falls within the true spirit and scope of the invention.

What is claimed is:

1. A portable personal property protector adapted to be mounted on or in an object to be protected comprising:

a level sensing switch, means for mounting said level sensing switch for movement about a given axis, means coupled to said level sensing switch for angularly displacing said level sensing switch about said axis, a key-operated switch, said means for displacing such level sensing switch including a mounting arrangement that is freely pivotable by gravity about said axis, said key-operated switch having first and second positions, means coupled to said key-operated switch for holding said mounting arrangement with respect to said device in said first position of said switch and for releasing said mounting to be freely pivotable in said second position of said key-operated switch, means for generating an alarm signal, and an electric circuit connected to said level sensing switch and alarm generating means for energizing said alarm generating means by way of said level sensing switch and key-operated switch.

2. The portable anti-theft device of claim 1 wherein said means for holding comprises means responsive to operation of said key-operated switch for holding said mounting means.

3. The portable anti-theft device of claim 1 wherein said means for mounting said level-sensing switch for movement about a given axis comprises user-operable handle means coupled to rotate said level-sensing switch.

4. A portable anti-theft device adopted to be mounted on or in an object to be protected comprising:

a housing, a gravity-operated switch, mounting means for mounting said gravity-operated switch to be freely pivotable about a given axis in said housing, a key-operated switch means for selecting mechanically holding said mounting means against pivotal movement with respect to said housing, means for generating an alarm signal, and an electric circuit connected to said key-operated switch and alarm generating means by way of said key-operated switch and gravity-operated switch, said means for holding said mounting means comprising a cam responsive to said key-operated switch.

5. A portable anti-theft device of claim 4 wherein said gravity-operated switch is a mercury switch.

* * * * *